US012781604B2

(12) United States Patent
Gratia

(10) Patent No.: US 12,781,604 B2
(45) Date of Patent: Nov. 3, 2026

(54) SYSTEMS AND METHODS FOR WELL LIFTING OPERATION ASSISTANCE

(71) Applicant: Saudi Arabian Oil Company, Dhahran (SA)

(72) Inventor: Paolo Ilham Sola Gratia, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 146 days.

(21) Appl. No.: 18/788,670

(22) Filed: Jul. 30, 2024

(65) Prior Publication Data

US 2026/0036025 A1 Feb. 5, 2026

(51) Int. Cl.
*E21B 43/16* (2006.01)

(52) U.S. Cl.
CPC ..... *E21B 43/168* (2013.01)

(58) Field of Classification Search
None
See application file for complete search history.

(56) References Cited

U.S. PATENT DOCUMENTS

2019/0292888 A1* 9/2019 Archa ..... E21B 43/122
2020/0032627 A1* 1/2020 Salihbegovic ..... E21B 47/117

* cited by examiner

*Primary Examiner* — Anuradha Ahuja
(74) *Attorney, Agent, or Firm* — Dinsmore & Shohl LLP

(57) ABSTRACT

A system, method, and chamber assembly for producing a multiphase formation fluid from a subsurface formation. The chamber assembly includes a mandrel that is positioned adjacent to a passageway, with the passageway extending from a top connection to a bottom connection. The chamber assembly further includes a mandrel chamber that is located within the mandrel. The mandrel chamber includes at least one pressurized gas container, at least one friction coil having a first end and a second end, and an injection port, wherein the first end of the at least one friction coil is fluidly coupled to the at least one pressurized gas container and the second end of the at least one friction coil is fluidly coupled to the injection port. In addition, the chamber assembly also includes a shearing disk operatively coupled to the injection port, the shearing disk positioned within the passageway.

20 Claims, 6 Drawing Sheets

SYSTEMS AND METHODS FOR WELL LIFTING OPERATION ASSISTANCE

TECHNICAL FIELD

Embodiments herein generally relate to systems and methods of well lifting operations, and particularly to systems and methods for assisting well lifting operations using a pressurized gas chamber assembly.

BACKGROUND

In a depleted reservoir well, or in a well that has been recently completed, the reservoir pressure may not be sufficiently high enough to overcome the hydrostatic pressure of the completion fluid left in the well to allow hydrocarbons to flow to the surface. Completion fluids are essentially highly saturated salt solutions and are pumped into the borehole as the drilling takes place. Because of their high density created by dissolved salts, completion fluids exert outward pressure on their surroundings. This is known as hydrostatic pressure. Because they are so dense, they tend to "push" less dense fluids like oils or fresh or seawater away. In the context of well-drilling, they prevent these less dense or formation fluids from entering the bore shaft.

One of the conventional methods to assist in flowing the well is to utilize a coiled tubing unit (CTU) and nitrogen processing. Coiled tubing refers to a continuous length of small-diameter flexible steel (or equivalent) pipe, e.g., tubing. The CTU includes the reel to which the coiled tubing is spooled. The tubing is unspooled off the reel and fed through a gooseneck, directing the tubing downward to an injector head and straightened prior to entering the borehole. A high-pressure swivel joint on the reel enables the pumping of fluids, e.g., nitrogen, through the tubing.

Typically, the coiled tubing is deployed inside the well casing, e.g., tubing, to lifting depth and nitrogen is pumped through the coiled tubing, exiting a nozzle to the annulus between the tubing and coiled tubing. The nitrogen then lightens the hydrostatic column of the well. The lighter hydrostatic column then allows the reservoir to flow hydrocarbon to the surface. In flowback operations, pumping of nitrogen is performed continuously until heavy completion fluid is flowed back (to the surface) and the reservoir can flow naturally. The average time for this conventional process is around a minimum of four days, including two days for rig up and rig down time of the CTU along with a minimum of one to two days to flowback the well. Another conventional method to lift the well is utilizing a swabbing technique. Such a swabbing technique utilizes swabbing tools to remove completion fluid out of the wellbore, thereby reducing hydrostatic pressure in the wellbore to allow reservoir flows of the hydrocarbon. The swabbing technique is less effective compared to CTU and nitrogen units operations.

SUMMARY

Accordingly, systems and methods are desired to allow for the relief of hydrostatic pressure in the wellbore to allow reservoirs to flow fluid from a subsurface formation, without the time consuming and extensive process of inserting CTU into the wellbore. Embodiments herein address the aforementioned need by placing a self-contained hydrostatic pressure relief component within the wellbore itself. This in situ placement negates the need for insertion of a separate CTU component into the wellbore, and can be utilized faster, with less extraneous equipment.

According to the subject matter of the present disclosure, there is provided a chamber assembly that includes a mandrel containing a pressurized gas container and friction coils, which can be triggered to insert gas into the wellbore, thereby alleviating hydrostatic pressure. The chamber assembly may be implemented with a passageway configured to fluidly couple to a tubing string element or elements, and may be placed within various positions within the wellbore. An injection port, coupled to the friction coils, is positioned within the passageway of the chamber assembly. A shearing disk covers the injection port, preventing the flow of gas until needed. To relieve hydrostatic pressure, a downhole plug is interested into the wellbore above the reservoir and below the chamber assembly to be activated. Pressure is applied from the surface to shear the shearing disk, thereby exposing the injection port. Gas then flows from the pressurized container in the mandrel through the friction coils to obtain the needed pressure and/or flow rate and exits into the passageway through the injection port. The downhole plug is removed and the gas entering the wellbore eases the hydrostatic pressure, allowing multiphase formation fluid to flow to the surface from the reservoir.

In accordance with one embodiment of the present disclosure, there is provided a system for producing a multiphase formation fluid from a subsurface formation utilizing at least one chamber assembly. The system includes a surface collection point, a wellbore that extends from the surface collection point to the subsurface formation, a packer that is positioned within the wellbore, and the at least one chamber assembly. The at least one chamber assembly includes a mandrel that is positioned adjacent to a passageway that extends from a top connection to a bottom connection. The at least one chamber assembly also includes a mandrel chamber located within the mandrel, which includes at least one pressurized gas container fluidly coupled to a first end of at least one friction coil. The at least one chamber assembly further includes a shearing disk that is operatively coupled to a second end of the at least one friction coil, and which is positioned within the passageway. The system further includes a tubing string component that is fluidly coupled to the bottom connection of the at least one chamber assembly such that the passageway and the first tubing string together define a fluid pathway from the subsurface formation to the surface collection point. The at least one chamber assembly is configured to release a gas from the at least one pressurized gas container through the at least one friction coil into the passageway to relieve hydrostatic pressure in the wellbore to flow the multiphase formation fluid through the fluid pathway to the surface collection point.

In accordance with another embodiment of the present disclosure, there is provided a chamber assembly for producing a multiphase formation fluid from a subsurface formation. The chamber assembly includes a mandrel that is positioned adjacent to a passageway, with the passageway extending from a top connection to a bottom connection. The chamber assembly further includes a mandrel chamber that is located within the mandrel. The mandrel chamber includes at least one pressurized gas container, at least one friction coil having a first end and a second end, and an injection port, wherein the first end of the at least one friction coil is fluidly coupled to the at least one pressurized gas container and the second end of the at least one friction coil is fluidly coupled to the injection port. In addition, the chamber assembly also includes a shearing disk operatively coupled to the injection port, the shearing disk positioned within the passageway.

In accordance with still another embodiment of the present disclosure, there is provided a method for method of producing multiphase formation fluid by a system utilizing at least one chamber assembly. The method includes positioning, in a wellbore comprising at least one tubing string component, at least one chamber assembly fluidly coupled to the at least one tubing string component. The at least one chamber assembly includes a mandrel positioned adjacent to a passageway, such that the passageway extends from a top connection to a bottom connection, the bottom connection coupled to the at least one tubing string component. The at least one chamber assembly also includes a mandrel chamber that is located within the mandrel and which includes at least one pressurized gas container, at least one friction coil having a first end and a second end, and an injection port. The first end of the at least one friction coil is fluidly coupled to the at least one pressurized gas container and the second end of the at least one friction coil is fluidly coupled to the injection port. The at least one chamber assembly also includes a shearing disk operatively coupled to the injection port, the shearing disk positioned within the passageway. The method includes inserting a downhole plug into the at least one tubing string component through the passageway of the at least one chamber assembly, and applying a pressure downward to shear the shearing disk, thereby exposing the injection port within the passageway. The method further includes removing the downhole plug from the at least one tubing string component, and releasing a gas from the at least one pressurized gas container through the at least one friction coil into the passageway to relieve hydrostatic pressure in the wellbore to flow the multiphase formation fluid through the at least one tubing string component and the passageway to a surface collection point.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
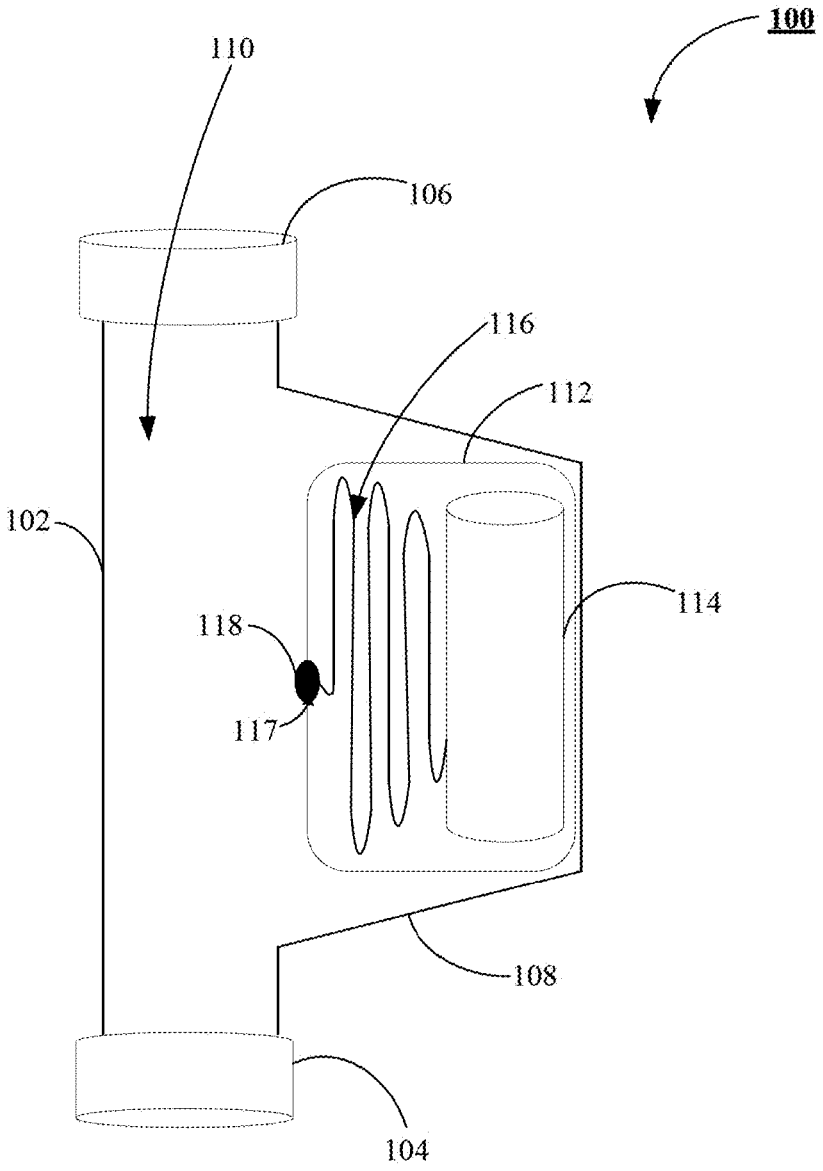
FIG. 1 illustrates a chamber assembly in accordance with some aspects contemplated and described herein.

These and other aspects of the present methods are described in further detail below with reference to the accompanying figures, in which one or more illustrated embodiments and/or arrangements of the systems and methods are shown. In the description of the embodiments that follows, like numerals denote like components across the various figures. The systems and methods of the present application are not limited in any way to the illustrated embodiments and/or arrangements. It should be understood that the systems and methods as shown in the accompanying figures are merely exemplary of the systems and methods of the present application, which can be embodied in various forms as appreciated by one skilled in the art. Therefore, it is to be understood that any structural and functional details disclosed herein are not to be interpreted as limiting the present systems and methods, but rather are provided as a representative embodiment and/or arrangement for teaching one skilled in the art one or more ways to implement the present systems and methods.

DETAILED DESCRIPTION

Embodiments herein generally relate to systems and methods for multiphase formation fluid production, and particularly to systems and methods for multiphase formation fluid production utilizing a pressurized gas chamber assembly for well lifting operations. The methods and systems herein are described, in some instances, in the context of subsurface formations. However, it should be understood that the methods and systems described herein may have applicability with other formations above and below the surface, as would be appreciated by those skilled in the art.

As used herein, the terms "downhole" and "uphole" may refer to a position within a wellbore relative to the surface, with uphole indicating a direction or position closer to the surface and downhole referring to a direction or position farther away from the surface. Similarly, as used herein, the terms "downward" and "upward" may refer to a position within a subterranean environment or subsurface formation relative to the surface, with upward indicating a direction or position closer to the surface and downward referring to a direction or position farther away from the surface.

As described herein, a "subsurface formation" may refer to a body of rock that is continuous and sufficiently distinctive from the surrounding rock bodies that the body of the rock may be mapped as a distinct entity. A subsurface formation is, therefore, sufficiently homogenous to form a single identifiable unit containing similar properties throughout the subsurface formation, including, but not limited to, porosity and permeability.

As used herein, "wellbore," may refer to a drilled hole or borehole extending from the surface of the Earth down to the subsurface formation, including the openhole or uncased portion. The wellbore may form a pathway capable of permitting fluids to traverse between the surface and the subsurface formation. The wellbore may include at least a portion of a fluid conduit that links the interior of the wellbore to the surface. The fluid conduit connecting the interior of the wellbore to the surface may be capable of permitting regulated fluid flow from the interior of the wellbore to the surface and may permit access between equipment on the surface and the interior of the wellbore.

As used herein, a "wellbore wall" may refer to the interface through which fluid may transition between the subsurface formation and the interior of the wellbore. The wellbore wall may be unlined (that is, bare rock or formation) to permit such interaction with the subsurface formation or lined, such as by a tubular string, to prevent such interactions. The wellbore wall may also define the void volume of the wellbore.

Referring now to FIG. 1, there is shown an exemplary chamber assembly 100 in accordance with some aspects disclosed herein. In accordance with some aspects, the chamber assembly 100 may be implemented as a modular assembly, configured to be installed during or after formation of a well. Further, the chamber assembly 100, as discussed in greater detail below, may be positioned at a variety of locations within the well, and discussion herein is not intended to imply any limitations on location of the chamber assembly.

The exemplary chamber assembly 100 of FIG. 1 may include a body 102 having a bottom connection 104, a top connection 106, and a mandrel 108. It will be appreciated that the body 102 may be of a substantially cylindrical construction, including an internal passageway 110 corresponding to the tubing in the well to which the chamber assembly 100 is coupled. That is, the inner diameter of the passageway 110 may be implemented with the same diameter as that of the tubing (not shown) to which the chamber assembly 100 is attached.

In accordance with some aspects disclosed herein, the mandrel 108 may include a mandrel chamber 112 housing, for example and without limitation, a pressurized gas container 114 (e.g., Nitrogen ($N_2$)), one or more friction coils 116, and a shearing disk 118 covering an injection port 117. In some aspects, the gas container 114 is pressurized to a certain pressure required to store a sufficient amount of pressurized gas, e.g., $N_2$, to lift the well. The mandrel chamber 112 may include a fill port (not shown) coupled to the pressurized gas container 114 to enable initial fill-up or replenishment of gas into the pressurized gas container 114. In such an aspect, the port (not shown) may extend from the mandrel chamber 112 to an outer surface of the mandrel 108, thereby providing a location from which the pressurized gas container 114 may be replenished. Once the shearing disk 118 is sheared, gas may flow from the pressurized gas container 114 in the mandrel chamber 112 through the friction coils 116. The friction coils 116 may function to regulate the gas injection rate and pressure as it exits from the mandrel chamber 112 into the wellbore, e.g., into the passageway 110 through an injection port 117 uncovered by removal of the shearing disk 118. As will be appreciated, range of pressure/rates are variables dependent upon on well/production parameters (reservoir pressure, tubing size, required drawdown, flow rate expectation, etc.). According to some aspects, the friction coils 116 can be designed in terms of size and length in accordance with well design parameters, including for example and without limitation, reservoir pressure, tubing size, drawdown pressure and desired production flow rate to regulate the gas injection rate and pressure to a desired value.

Turning now to FIGS. 2A-2D, there are shown a progression of views of a wellbore diagram of a system 150 utilizing the chamber assembly 100 for production of a multiphase formation fluid 124 in accordance with some aspects disclosed herein. As shown in FIGS. 2A-2D, the system 150 may include a subsurface formation 122, a wellbore 120, one or more tubing string components 126, a chamber assembly 100, and a packer 134. It will be appreciated that additional components associated with production of multiphase formation fluids 124 may also be included, e.g., pumps, surface collections, gas separators, valves, storage units, etc., may also be included in the system 150 shown in FIGS. 2A-2D. As shown in FIGS. 2A-2D, the wellbore 120 may extend from a surface collection point to the subsurface formation 122. Further, the subsurface formation 122 of FIGS. 2A-2D may include or contain the multiphase formation fluid 124. In accordance with some aspects, the multiphase formation fluid 124 may comprise a liquid phase and a gaseous phase. The liquid phase may comprise liquid hydrocarbons and/or water. The gaseous phase may comprise hydrocarbon gases and/or acid gases (such as, but not limited to hydrogen sulfide, carbon dioxide, and carbon monoxide).

As described herein, the water may be pure water or any aqueous solution such as those selected from the group consisting of formation water; filtered seawater; untreated seawater; natural salt water; brackish salt water; saturated salt water; synthetic brine; mineral waters; potable water containing one or more dissolved salts, minerals, and organic materials; non-potable water containing one or more dissolved salts, minerals, and organic materials; deionized water; tap water; distilled water; fresh water; or combinations thereof.

The subsurface formation 122, and thereby the multiphase formation fluid 124 may have a temperature of at least 30° C., such as from 30° C. to 80° C., from 80° C. to 100° C., from 100° C. to 150° C., from 150° C. to 200° C., from 200° C. to 400° C., or any combination of the previous ranges or smaller range therein, such as from 50° C. to 200° C. The subsurface formation 122, and thereby the multiphase formation fluid 124, may also have a pressure of at least 500 psi, such as from 500 psi to 1,000 psi, from 1,000 psi to 2,000 psi, from 2,000 psi to 3,000 psi, from 3,000 psi to 4,000 psi, from 4,000 psi to 6,000 psi, from 6,000 psi to 10,000 psi, or any combination of the previous ranges or smaller range therein, such as from 500 psi to 4,000 psi.

As referenced above, the system 150 shown in FIGS. 2A-2D may further include a packer 134, positioned within the wellbore 120. The packer 134 depicted in FIGS. 2A-2D may also comprise one or more swellable, inflatable, or radially extendible means, that, when actuated, may isolate an upper section 119 of the wellbore 120 above the packer 134 and a lower section 121 of the wellbore 120 below the packer 134, as would be understood in the art. As shown in FIGS. 2A-2D, the lower section 121 of the wellbore 120 may also coincide with some or all of the subsurface formation 122, although this is not necessary. Further, a reservoir 123 in which the multiphase fluid 124 is disposed may be located coincident with the lower section 121, or generally within the subsurface formation 122, as will be appreciated. Without being limited by theory, such swellable, inflatable, or radially extendible means may provide isolation that may only permit flow of the multiphase formation fluid 124 through a cavity 135 of the packer 134.

In some aspects described and disclosed herein, the packer 134 positioned within the wellbore 120 may define a cavity 135 extending from a top surface of the packer 134 to a bottom surface of the packer 134. Although not illustrated, the cavity 135 may include fastening means on the top surface and/or the bottom surface for coupling another component thereto. The fastening means may be any understood in the art, such as, but not limited to, male-female threaded connections. In accordance with other aspects contemplated herein, the cavity 135 of the packer 134 may be configured to form a contact seal against a tubing string component 126, and the like. Further, while illustrated in FIGS. 2A-2D as a single-string packer, the packer 134 may be configured as a dual-string packer (two cavities) or a multi-string packer (two or more cavities) without departing from the aspects, systems, and methods described herein. Accordingly, it is to be appreciated that the illustration in FIGS. 2A-2D of a single string packer 134 is intended solely as one non-limiting example of the use of the chamber assembly 100 in accordance with some aspects.

The system 150 shown in FIGS. 2A-2D may further include one or more tubing string components 126, which may be coupled and fluidly connected to the chamber assembly 100. As shown in FIGS. 2A-2D, a top connection 128 of the representative tubing string component 126 is coupled to and fluidly connected to the bottom connection 104 of the chamber assembly 100. The bottom connection 130 of the tubing string component 126 may, as discussed above, be fluidly coupled to the packer 134, or, as shown in FIGS. 2A-2D extend through the cavity 135 to couple to another tubing string component (not shown) or other component in contact with the multiphase formation fluid 124, e.g., a gas separator, pump, inlet, etc. Accordingly, as illustrated in FIGS. 2A-2D, the passageway 110 of the chamber assembly 100, and the at least one tubing string component 126 may together define a fluid pathway from the reservoir 123 to a surface collection point. As will be appreciated, the surface collection point (not shown) may comprise a wellhead configured to accept the top connection 106 of the chamber assembly 100, a tubing string component, and the like. In some aspects, the surface collection point may also include a wellhead flange, tubing hangers, various valves (check, choke, etc.), piping to a treatment facility, piping to a storage facility, and myriad other components associated with the production of multiphase formation fluid 124, as will be appreciated by the skilled artisan.

In some environments, such as in a depleted reservoir well, a well that has been recently completed, or a well in which residual pressure of the multiphase fluid formation 124 has been reduced, the reservoir pressure may not be sufficiently high to overcome the hydrostatic pressure of the multiphase formation fluid 124 left in the well to allow hydrocarbons to flow to the surface. As noted above, completion fluids are essentially salt solutions and are pumped into the borehole as the drilling takes place. Because of their high density created by dissolved salts, completion fluids exert outward pressure on their surroundings. This is known as hydrostatic pressure. Because they are so dense, they tend to "push" less dense fluids like oils or fresh or seawater away. In the context of well-drilling, they prevent these less dense or formation fluids from entering the bore shaft. Such an occurrence is shown in the illustration of FIGS. 2A-2D.

Figure 2A:
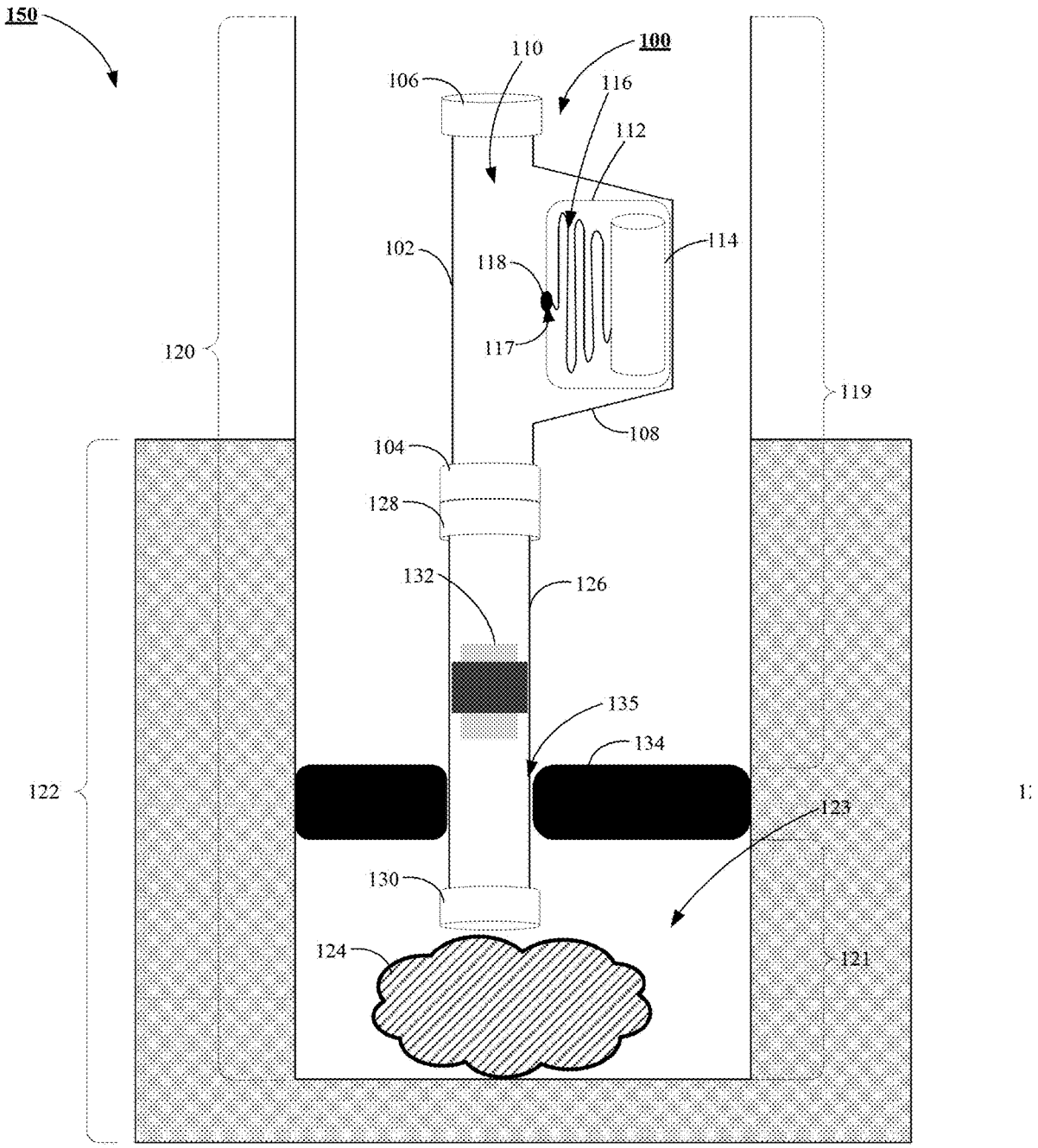
FIGS. 2A-2D illustrate views of a system utilizing a chamber assembly in accordance with some aspects contemplated and described herein.

Referring now to FIG. 2A, when such an occurrence, e.g., hydrostatic pressure prevents the flow of the multiphase formation fluid 124 through the one or more tubing strings 126, a removable downhole plug 132 is inserted into the one or more tubing strings 126, positioned below the chamber assembly 100. As shown in FIG. 2A, the downhole plug 132 may comprise one or more swellable, inflatable, or radially extendible means, that, when actuated, may isolate portions of the one or more tubing strings 126 from the chamber assembly 100. After the downhole plug 132 is positioned below the chamber assembly 100, it is expanded within the tubing string 126. Pressure is then applied downward toward the downhole plug 132 from the surface to shear the shearing disk 118 of the chamber assembly 100.

Figure 2B:
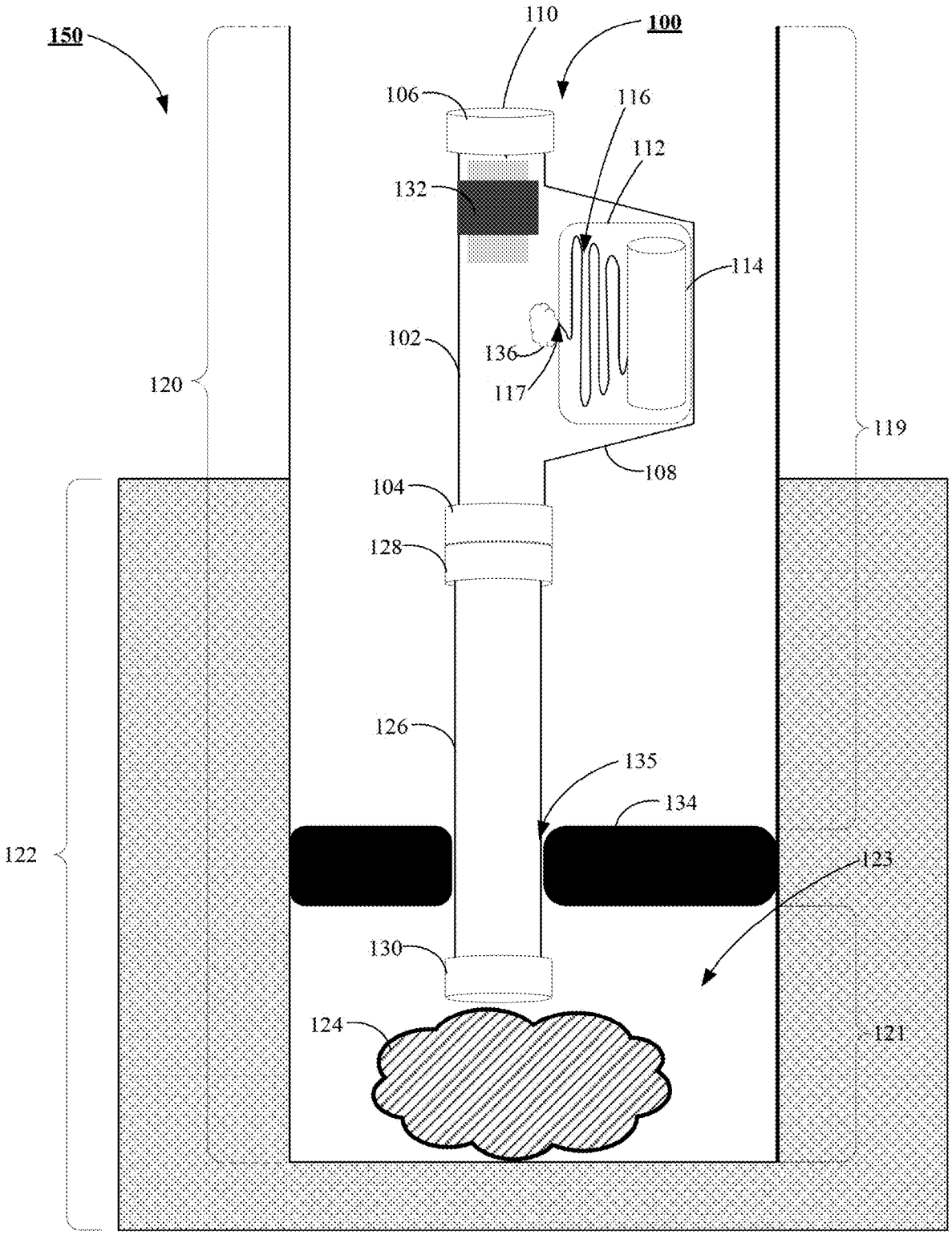

After shearing of the shear disk 118, as shown in FIG. 2B, the downhole plug 132 is retrieved from the tubing string 126 and chamber assembly 100. As the downhole plug 132 is retrieved, gas 136 is injected into the passageway 110 of the chamber assembly 100 and tubing string 126 as illustrated in FIG. 2B. It will be appreciated that upon shearing of the shear disk 118, gas 136 stored in the pressurized gas container 114 in the mandrel chamber 112 is expelled through the one or more friction coils 116 into the tubing string 126 and the passageway 110 of the chamber assembly 100.

Figure 2C:
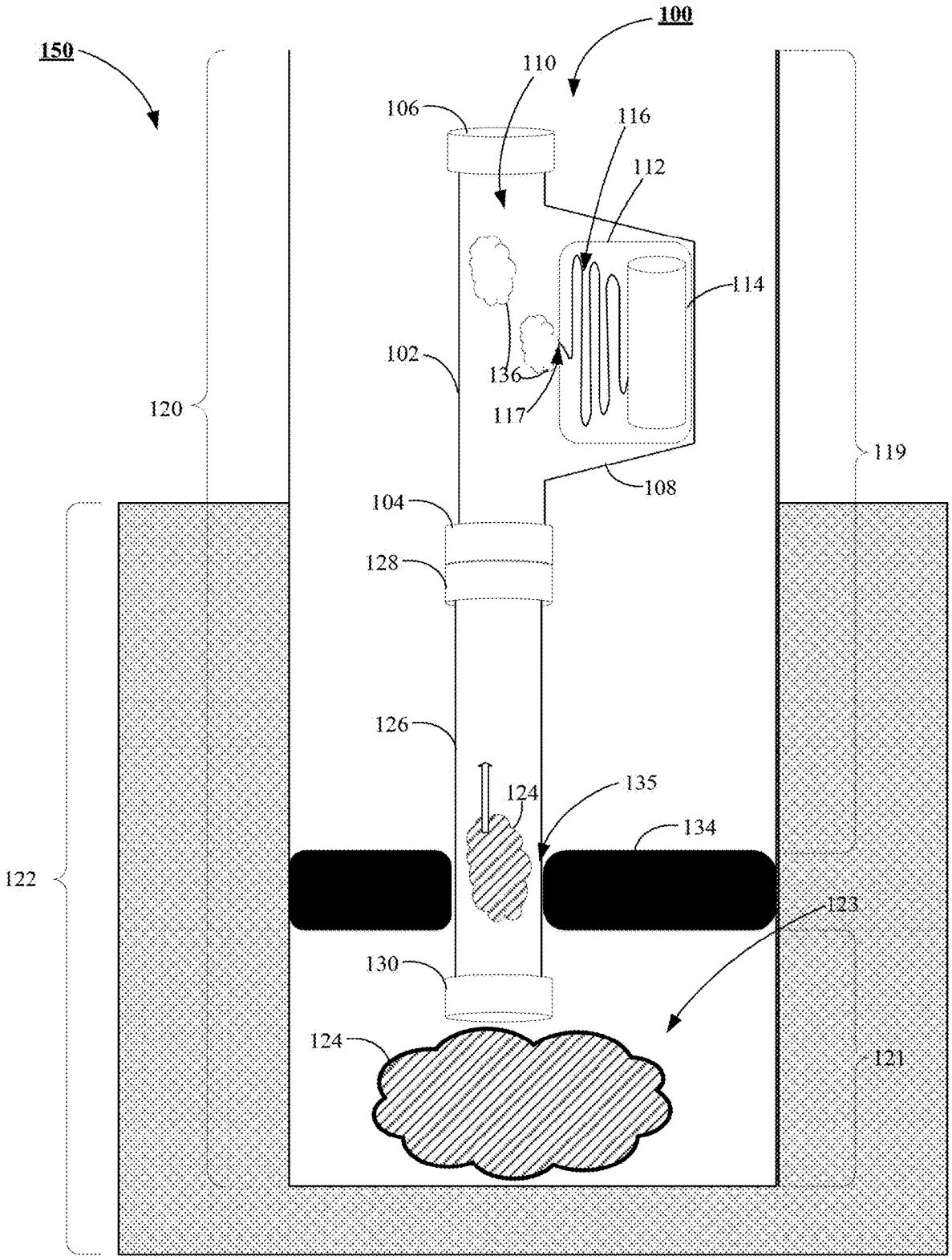
Figure 2D:
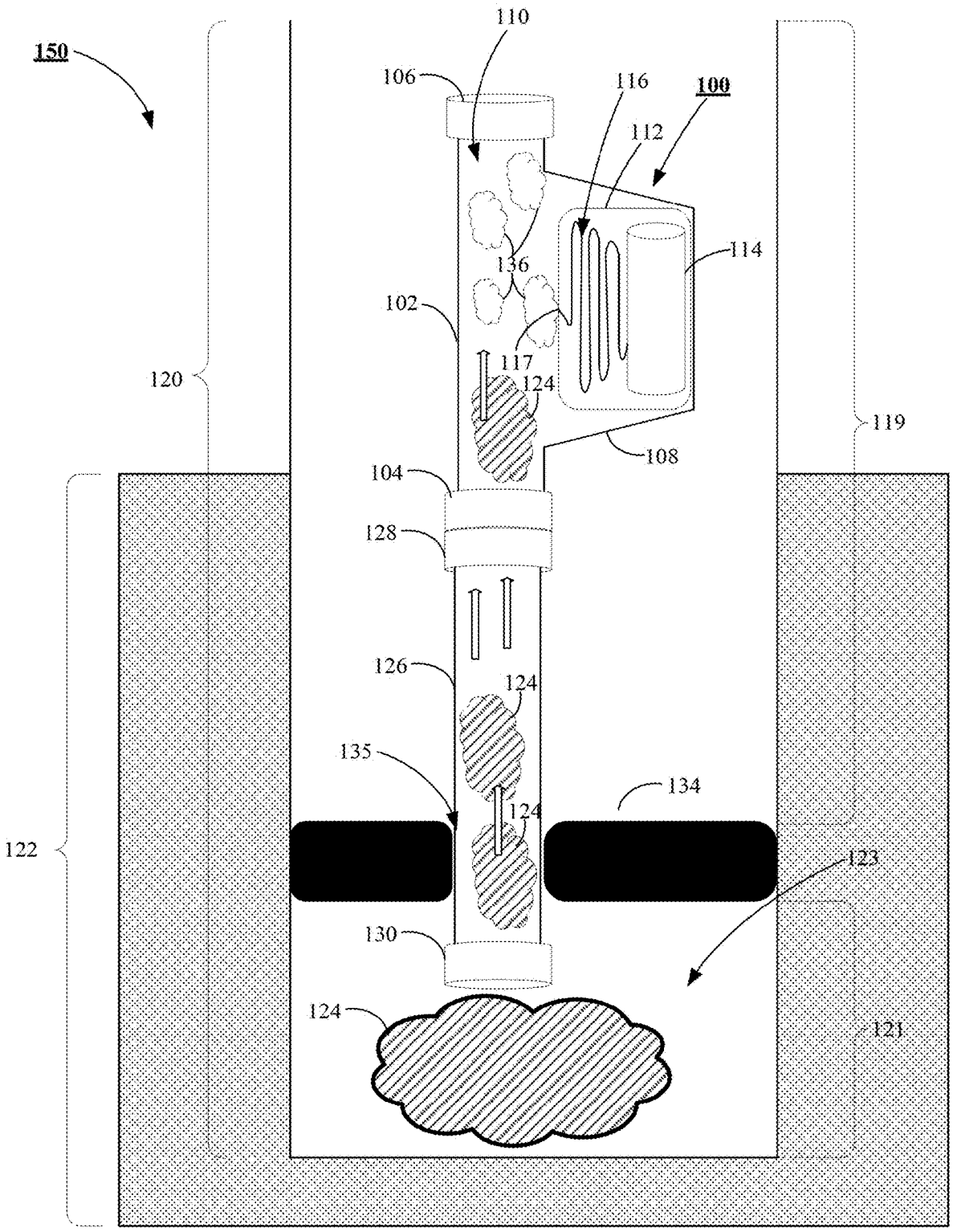

As shown in FIGS. 2C-2D, gas 136 continues to be injected into the chamber assembly 100 and tubing string 126 at a predetermined injection pressure and injection rate as regulated by the aforementioned one or more friction coils 116. It will be appreciated that while more gas 136 is injected into the passageway 110 of the chamber assembly 100 and tubing string 126, hydrostatic pressure above reservoir 123 will be reduced due to the lighter gas 136 replacing heavier completion fluid, thereby allowing the reservoir 123 to produce the multiphase formation fluid 124. In accordance with some aspects contemplated and disclosed herein, the gas 136 may be continuously injected until the pressurized gas container 114 is depleted, with the heavy completion fluid or multiphase formation fluid 124 flowed up or back to the surface, enabling the well to flow naturally.

Figure 3:
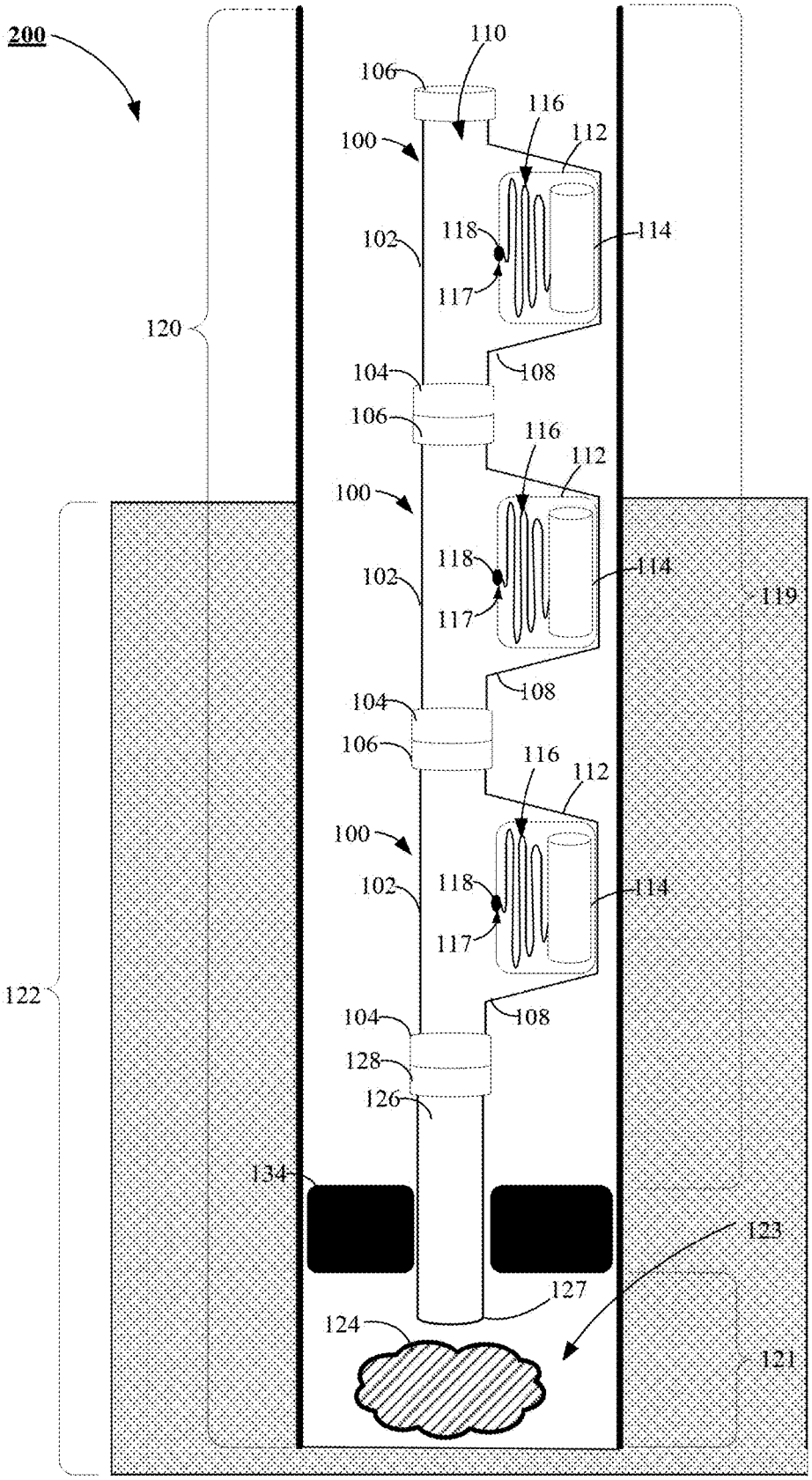
FIG. 3 illustrates a system utilizing multiple chamber assemblies in accordance with some aspects contemplated and described herein.

In accordance with some aspects contemplated herein, multiple chamber assemblies 100 may be utilized in a system 200 for production of multiphase formation fluid 124. FIG. 3 provides an illustrative view of one such example system 200 utilizing three chamber assemblies 100, however it will be appreciated that any number of such chamber assemblies 100 may be used in accordance with wellbore depth, pressure in the reservoir 123, type or amount of multiphase formation fluid 124, or the like. Accordingly, the illustration of three chamber assemblies 100 is intended solely as one non-limiting example of such a multiple chamber system 200.

As shown in FIG. 3, the system 200 includes three chamber assemblies 100 coupled in series and deployed in the wellbore 120. The system 200 illustrated in FIG. 3 further includes a packer 134, positioned in the wellbore 120 below the multiple chamber assemblies 100. As referenced above with respect to the system 150 of FIGS. 2A-2D, the packer 134 may be implemented as one or more swellable, inflatable, or radially extendible means, that, when actuated, may isolate an upper section 119 of the wellbore 120 above the packer 134 from a lower section 121 of the wellbore 120 below the packer 134. In the example illustration of FIG. 3, the packer 134 is positioned on or around the tubing string component 126, however in other aspects, the packer 134 may be positioned on or around one of the chamber assemblies 100, in accordance with the depth and/or construction of the wellbore 120, as will be appreciated. Continuing with the example of FIG. 3, the tubing string component 126 extends into the lower section 121 of the wellbore 120 below the packer 134. It will be appreciated that while a single tubing string component 126 is shown in FIG. 3, the system 200 employing multiple chamber assemblies 100 may comprising any number of tubing string components 126 in accordance with the depth and other considerations associated with the wellbore 120. Located coincident with the lower section 121, or generally within the subsurface formation 122, is a reservoir 123 containing completion and/or multiphase formation fluid 124.

As referenced above, the packer 134 within the wellbore 120 may define a cavity 135 extending from the top surface through to the bottom surface of the packer 134. In some aspects, the cavity 135 may include fastening means on the top and/or bottom surfaces of the packer 134 configured to engage corresponding ends of tubing string components 126, as will be appreciated by those skilled in the art. In accordance with other aspects contemplated herein, the cavity 135 of the packer 134 may be configured to sealably contact the tubing string component 126, and the like. It will be appreciated that while illustrated in FIG. 3 as a single-string packer, the packer 134 may be configured as a dual-string packer (two cavities) or a multi-string packer (two or more cavities) without departing from the aspects, systems, and methods described herein. Accordingly, it is to be appreciated that the illustration in FIG. 3 of a single string packer 134 is intended solely as one non-limiting example of the use of the multiple chamber assembly system 200 in accordance with some aspects.

As depicted in FIG. 3, the system 200 includes at least one tubing string component 126, coupled and fluidly connected to the bottommost chamber assembly 100. A top connection 128 of the at least one tubing string component 126 coupled to and fluidly connected to the bottom connection of the bottommost chamber assembly 100. A bottom 127 of the tubing string component 126 may, as discussed above, be fluidly coupled to the packer 134, or, as shown in FIG. 3, extend through the cavity 135 to couple to another tubing string component (not shown) or other component in contact with the multiphase formation fluid 124, e.g., a gas separator, pump, inlet, and the like. Accordingly, as illustrated in FIGS. 3, the passageway 110 of the multiple chamber assemblies 100, and the at least one tubing string component 126 may together define a fluid pathway from the reservoir 123 to a surface collection point.

As noted above, a depleted or recently completed reservoir well may experience hydrostatic pressure preventing the flow of multiphase formation fluid 124 from the reservoir to the surface. Such hydrostatic pressure may result from the residual pressure in the reservoir being insufficient to move the multiphase formation fluid 124 or completion fluid in the system 300. Upon the occurrence of such an even in the system 300 of FIG. 3, the removable plug 132 (described above with respect to FIGS. 2A-2B) may be inserted to a desired depth of the wellbore 120, after which the plug 132 is expanded above the blockage or depth of the hydrostatically locked fluid 124. It will be appreciated that such location may occur at any depth within the wellbore 120. Pressure may then be applied downward toward the downhole plug 132 from the surface to shear the shearing disk 118 of one or more of the chamber assemblies 100. Thereafter, the downhole plug 132 may be retrieved from the wellbore 120. As the downhole plug 132 is retrieved, gas 136 is injected from the chamber assembly 100. It will be appreciated that upon shearing of the shear disk 118, gas 136 stored in the pressurized gas container 114 is expelled through the one or more friction coils 116 into the tubing string 126 and chamber assembly 100.

In some aspects of FIG. 3, it will be appreciated that the number and placement of the multiple chamber assemblies 100 may be dependent, for example and without limitation, on a desired production rate, desired gas injection rate and pressure, existing reservoir pressure, type of multiphase formation fluid 124 extracted, and the like. Although described herein as applicable to hydrostatic pressure issues resulting from near depletion or completion fluid issues, the system 300 shown in FIG. 3 may be configured for gas lift operations, as are known in the art, to increase production of multiphase formation fluid 124. In such a configuration, shearing of each chamber assembly shearing disk 118 may occur sequentially, simultaneously, or otherwise to ensure a desired production rate is achieved.

As previously mentioned above, aspects disclosed herein may be directed to methods for multiphase formation fluid 124 production utilizing a chamber assembly 100. The methods may initially comprise positioning one or more chamber assemblies 100 within a wellbore 120, fluidly coupled to at least one tubing string component 126. The method may then comprise actuating the packer 134 to isolate the upper section 119 of the wellbore 120 from the lower section 121 of the wellbore 120. The method may then comprise, in response to hydrostatic pressure preventing the flow of multiphase formation fluid 124 to the surface, inserting a downhole plug 132 through the passageway 110 of the chamber assembly 100 into the at least one tubing string component 126 and activating the downhole plug 132 within the at least one tubing string component 126. The method may further include applying a downward pressure from the surface to shear the shearing disk 118, thereby exposing the injection port 117 of the mandrel chamber 112 to the passageway 110. The method may also comprise deactivating the downhole plug 132 after shearing is completed and removal of the downhole plug 132 from the at least one tubing component 126 and the passageway 110. The method may further comprise releasing a gas 136 from the at least one pressurized gas container 114 through the at least one friction coil 116 into the passageway 110 via the injection port 117 to relieve hydrostatic pressure in the wellbore 120 to flow the multiphase formation fluid 124 through the at least one tubing string component 126 and the passageway 110 to a surface collection point.

It is noted that recitations in the present disclosure of a component of the present disclosure being "operable" or "sufficient" in a particular way, to embody a particular property, or to function in a particular manner, are structural recitations, as opposed to recitations of intended use. More specifically, the references in the present disclosure to the manner in which a component is "operable" or "sufficient" denotes an existing physical condition of the component and, as such, is to be taken as a definite recitation of the structural characteristics of the component.

It is also noted that recitations herein of "at least one" component, element, etc., should not be used to create an inference that the alternative use of the articles "a" or "an" should be limited to a single component, element, etc. The singular forms "a," "an" and "the" include plural referents, unless the context clearly dictates otherwise.

Throughout this disclosure ranges are provided. It is envisioned that each discrete value encompassed by the ranges are also included. Additionally, the ranges which may be formed by each discrete value encompassed by the explicitly disclosed ranges are equally envisioned.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising." It is noted that the use of the terms "having" or "including", or grammatical variations thereof, in this disclosure should also be interpreted in like manner as the more commonly used open-ended preamble term "comprising".

As used in this disclosure, terms such as "first" and "second" are arbitrarily assigned and are merely intended to differentiate between two or more instances or components. It is to be understood that the words "first" and "second" serve no other purpose and are not part of the name or description of the component, nor do they necessarily define a relative location, position, or order of the component. Furthermore, it is to be understood that the mere use of the term "first" and "second" does not require that there be any "third" component, although that possibility is contemplated under the scope of the present disclosure.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present embodiments herein in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present embodiments including, but not limited to, embodiments defined in the appended claims. More specifically, although some aspects of the present embodiments are identified herein as preferred or particularly advantageous, it is contemplated that the present embodiments is not necessarily limited to these aspects.

What is claimed is:

1. A system for producing a multiphase formation fluid from a subsurface formation utilizing a chamber assembly, the system comprising:
- a surface collection point;
- a wellbore extending from the surface collection point to the subsurface formation;
- a packer positioned within the wellbore;
- the chamber assembly comprising:
  - a mandrel positioned adjacent to a passageway, the passageway extending from a top connection to a bottom connection,
  - a mandrel chamber located within the mandrel, comprising a pressurized gas container fluidly coupled to a first end of a coil, and
  - a shearing disk operatively coupled to a second end of the coil, the shearing disk positioned within the passageway; and
- a tubing string component fluidly coupled to the bottom connection of the chamber assembly, the passageway and the tubing string component together defining a fluid pathway from the subsurface formation to the surface collection point, and
- wherein the chamber assembly is configured to release a gas from the pressurized gas container through the coil into the passageway to relieve hydrostatic pressure in the wellbore to flow the multiphase formation fluid through the fluid pathway to the surface collection point.

2. The system of claim 1, wherein the shearing disk is configured to shear in response to a pressure applied from the surface collection point.

3. The system of claim 2, wherein the system further comprises a removable downhole plug positioned within the tubing string component below the chamber assembly.

4. The system of claim 2, wherein the coil is configured to regulate the release of the gas from the pressurized gas container into the passageway.

5. The system of claim 4, wherein the released gas from the pressurized gas container enters the passageway through an injection port uncovered in response to the shearing of the shearing disk.

6. The system of claim 4, wherein the pressurized gas container further includes a fill port configured to enable an initial filling or replenishment of the gas in the pressurized gas container.

7. The system of claim 1, further comprising a plurality of the chamber assembly, the plurality of chamber assemblies fluidly coupled to each other in series above the packer.

8. The system of claim 7, wherein the plurality of the chamber assemblies are configured to inject gas into the wellbore in sequential or simultaneous operation.

9. The system of claim 1, wherein the multiphase formation fluid comprises hydrocarbons.

10. A chamber assembly for producing a multiphase formation fluid from a subsurface formation, comprising:
- a mandrel positioned within a wellbore and adjacent to a passageway, the passageway extending from a top connection to a bottom connection, the wellbore extending from a surface collection point to the subsurface formation;
- a mandrel chamber located within the mandrel, the mandrel chamber comprising:
  - a pressurized gas container,
  - a coil having a first end and a second end, and
  - an injection port, wherein the first end of the coil is fluidly coupled to the pressurized gas container and the second end of the coil is fluidly coupled to the injection port; and
- a shearing disk operatively coupled to the injection port, the shearing disk positioned within the passageway.

11. The chamber assembly of claim 10, wherein the shearing disk is configured to shear in response to an applied pressure, exposing the injection port.

12. The chamber assembly of claim 11, wherein the chamber assembly is configured to release a gas from the pressurized gas container through the coil into the passageway to relieve hydrostatic pressure in the wellbore to flow the multiphase formation fluid therethrough.

13. The chamber assembly of claim 10, wherein the pressurized gas container further includes a fill port configured to enable an initial filling or replenishment of the gas in the pressurized gas container.

14. The chamber assembly of claim 13, wherein the fill port extends from the pressurized gas container within the mandrel chamber to the surface collection point.

15. The chamber assembly of claim 10, wherein the coil is configured to regulate an injection of gas from the pressurized gas container into the passageway.

16. A method of producing multiphase formation fluid by a system utilizing a chamber assembly, comprising:
- positioning, in a wellbore comprising a tubing string component, the chamber assembly fluidly coupled to the tubing string component, the chamber assembly comprising:
  - a mandrel positioned adjacent to a passageway, the passageway extending from a top connection to a bottom connection, the bottom connection coupled to the tubing string component,
  - a mandrel chamber located within the mandrel, the mandrel chamber comprising:
    - a pressurized gas container;
    - a coil having a first end and a second end; and an injection port, wherein the first end of the coil is fluidly coupled to the pressurized gas container and the second end of the coil is fluidly coupled to the injection port, and a shearing disk operatively coupled to the injection port, the shearing disk positioned within the passageway;

inserting a downhole plug into the tubing string component through the passageway of the chamber assembly;

applying a pressure downward to shear the shearing disk, thereby exposing the injection port within the passageway;

removing the downhole plug from the tubing string component; and releasing a gas from the pressurized gas container through the coil into the passageway to relieve hydrostatic pressure in the wellbore to flow the multiphase formation fluid through the tubing string component and the passageway to a surface collection point.

17. The method of claim 16, wherein the coil is configured to regulate the release of the gas from the pressurized gas container into the passageway.

18. The method of claim 17, wherein the gas from the pressurized gas container enters the passageway through the injection port uncovered in response to the shearing of the shearing disk.

19. The method of claim 16, wherein the pressurized gas container further includes a fill port configured to enable an initial filling or replenishment of the gas in the pressurized gas container.

20. The method of claim 16, further comprising:

activating the downhole plug prior to applying the pressure downward; and deactivating the downhole plug subsequent to the applying pressure downward to shear the shearing disk.

* * * * *